US010619905B2

(12) United States Patent
Starling

(10) Patent No.: US 10,619,905 B2
(45) Date of Patent: Apr. 14, 2020

(54) PROTECTIVE AND COOLING DEVICE FOR BOTTLES

(76) Inventor: Gordon Sterling Starling, Statesboro, GA (US)

( * ) Notice: Subject to any disclaimer, the term of this patent is extended or adjusted under 35 U.S.C. 154(b) by 336 days.

(21) Appl. No.: 12/804,701

(22) Filed: Jul. 27, 2010

(65) Prior Publication Data

US 2011/0030418 A1 Feb. 10, 2011

Related U.S. Application Data

(60) Provisional application No. 61/273,596, filed on Aug. 6, 2009.

(51) Int. Cl.
*F25D 3/00* (2006.01)
*F25D 3/06* (2006.01)

(52) U.S. Cl.
CPC ..... *F25D 3/06* (2013.01); *F25D 2303/081* (2013.01); *F25D 2303/0841* (2013.01); *F25D 2303/0843* (2013.01); *F25D 2303/0844* (2013.01); *F25D 2331/803* (2013.01); *F25D 2331/804* (2013.01)

(58) Field of Classification Search
CPC ..... F25D 3/06; F25D 3/08
USPC ..... 62/457.5, 371, 457.1, 457.2
See application file for complete search history.

(56) References Cited

U.S. PATENT DOCUMENTS 1,310,161 A * 7/1919 Johnson ..... 220/509
1,907,606 A * 5/1933 Stoddard ..... B65D 85/305 217/19
3,067,901 A * 12/1962 Van Geem ..... B65D 9/06 217/17
4,424,687 A 1/1984 Morgan
4,554,798 A 11/1985 D'Amour et al.
4,821,525 A * 4/1989 Drummond, III ..... F25C 1/22 62/371
4,916,923 A 4/1990 Adams et al.
5,052,184 A 10/1991 Jarvis
5,437,165 A 8/1995 White et al.
6,062,411 A 5/2000 Garland
6,126,124 A 10/2000 Wagner
6,405,557 B1 6/2002 DeCastro et al.
6,626,006 B1 * 9/2003 Tedder ..... 62/457.7
6,763,678 B2 * 7/2004 Harper ..... 62/461
6,763,959 B2 * 7/2004 Tedder ..... F25D 3/08 211/153
D608,157 S 1/2010 White
8,065,889 B1 * 11/2011 Silberman ..... 62/457.7
(Continued)

*Primary Examiner* — Brian M King
(74) *Attorney, Agent, or Firm* — Nixon & Vanderhye P.C.

(57) ABSTRACT

An apparatus for conductive and convective cooling of the liquid contents of bottles in a thermally insulating chest. A plate with spaced holes each for receiving a respective bottle with a gap between each of the bottles and the side of the respective hole. A set of legs for supporting and stabilizing the plate within the chest and crushed ice, ice cubes and the like filling the volume between the plate's support surface, the exposed upper portions of the bottles and the associated sides of the chest. Conductive cooling is attained through direct contact between the bottles and the ice. Convective cooling occurs through the liquid contents of the bottles, the colder, more dense liquids in the upper portions of the bottles flowing down into and displacing the less dense and warmer liquid contents upwardly toward the ice.

4 Claims, 3 Drawing Sheets

(56) References Cited

U.S. PATENT DOCUMENTS

| | | | |
|---|---|---|---|
| 2004/0069009 | A1 | 4/2004 | Tedder |
| 2008/0029526 | A1 | 2/2008 | Campbell |

* cited by examiner

PROTECTIVE AND COOLING DEVICE FOR BOTTLES

This application is a nonprovisional continuation-in-part of provisional application No. 61/273,596 filed Aug. 6, 2009, by Gordon Sterling Starling, the sole inventor of the invention described and claimed herein and for which non-provisional application the benefit of the priority date of Aug. 6, 2009 is claimed.

BACKGROUND OF THE INVENTION

This invention relates to a structure for positioning an array of bottles within a thermally insulating chest, and more particularly to a plate having a number of spaced holes each to engage a respective bottle not only to prevent destructive contact among adjacent bottles but also to support a charge of ice in a manner that enables melting ice water to flow along the bottles' sides to improve cooling the bottles' contents, and the like.

Thermally insulating chests for cooling bottled beverages have been on the market for a number of years. In use, the bottled beverages usually are loaded haphazardly into a chest and a charge of ice cubes, crushed ice, or the like is packed over the bottles. The cooling effect on the bottle contents is random at best in that the contents of some of the bottles, exposed directly to the ice are chilled through thermal conduction and the contents in other bottles, somewhat removed from the ice are less effectively cooled. The bottles, moreover, placed randomly within the chest frequently lay on their respective sides and thus promote leakage, particularly from bottles that have been opened and then reclosed.

As the ice melts, the motion restraining effect of the packed ice on the bottles diminishes and those bottles, especially those that have been opened and reclosed, are likely to fall on their sides and leak their contents into the chest. Consequently, any upright bottles tend to tip over onto their respective sides, the bottles also gradually becoming free to collide with one another in the course of moving the insulating chest during use. Occasionally, these collisions among the bottles will produce breakage.

This is an unsatisfactory state of affairs and a need exists for a better way to stow bottled beverages in insulating chests.

BRIEF SUMMARY OF THE INVENTION

These and other disadvantages of the prior art are largely overcome through the practice of the invention.

For example, a flat plate for restraining an array of bottles is mounted within a cooling chest. The plate is provided with a group of spaced holes, each of the holes sized to be slightly larger than the maximum diameter of most of the beverage bottles on the market. The bottles each are placed upright in their respective holes in the plate. Ice cubes, crushed ice and the like are packed over the plate in between and on top of the portions of the bottles that protrude above the exposed support surface of the plate. As the ice melts, the cold melted ice water drains through the spaces between the bottles and the sides of their respective holes to the bottom of the chest. In this way, the melted ice water cools the bottles in a uniform manner and also prolongs the life of the ice in the chest. These holes, moreover, separate the bottles through a sufficient distance to prevent the bottles from smashing into each other while enabling the melted ice water that drains into the bottom of the insulating chest to flow freely among the bottles further to improve cooling.

This feature of the invention is of salient interest because it induces convective currents within the fluid contents of the individual bottles that further increase the cooling efficiency of the structure. Illustratively, the ice, packed around the upper portion of the bottles, cools the liquid contents in the upper parts of the bottles, increasing the density of the cooled liquid relative to the warmer, less dense liquid contents in the lower portions of the bottles. The warmer, less dense liquid contents move into the upper bottle portions, having been displaced by a downward flow of the cooler, more dense fluids. Accordingly, a convective cooling circulation commences within the bottles that utilize the ice more efficiently and creates a more uniform distribution of the cooled bottles contents.

For a more complete appreciation of the invention, attention is invited to the following detailed description of a preferred embodiment of the invention, when taken with the figures of the drawing. The scope of the invention, however, is limited only through the claims appended hereto.

DETAILED DESCRIPTION OF THE INVENTION

Figure 1:
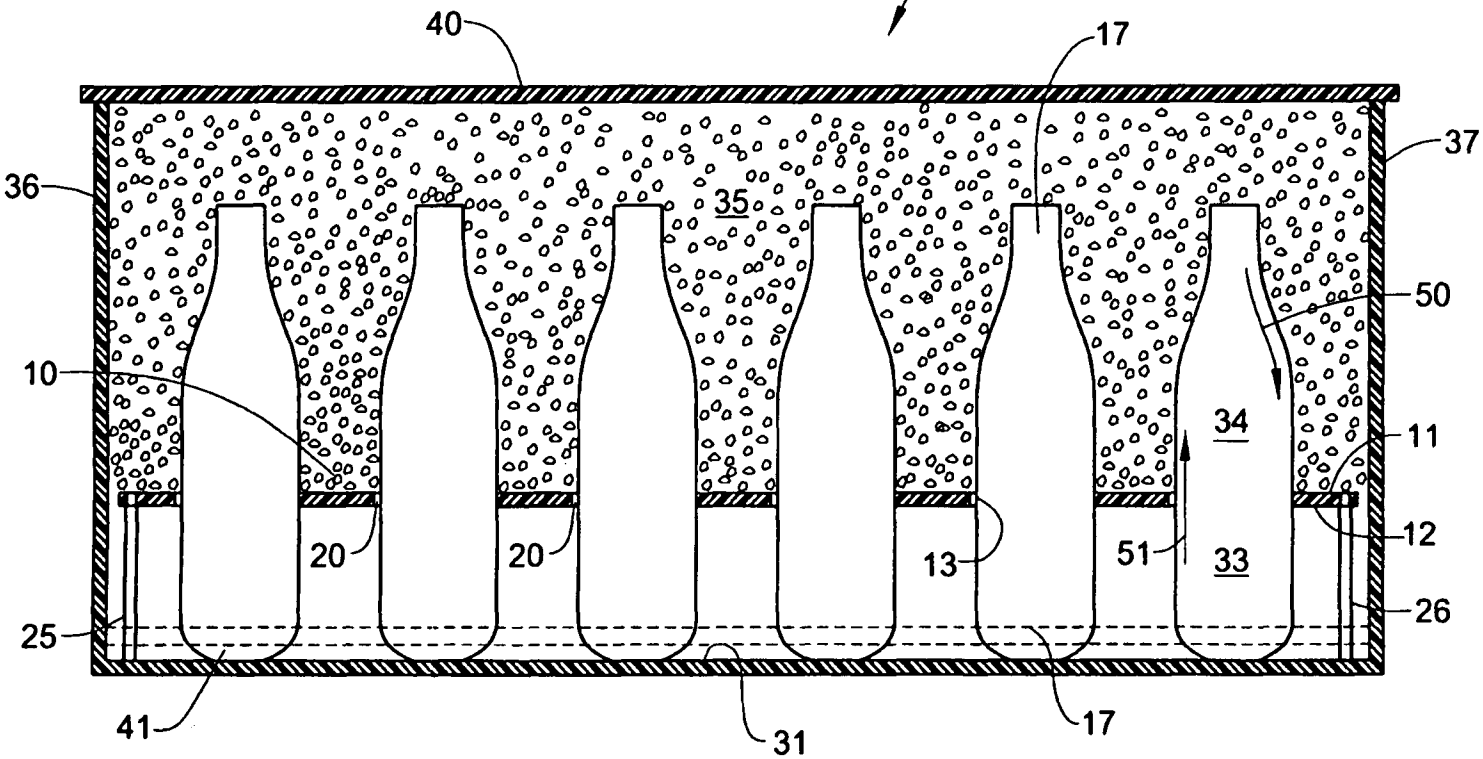
FIG. 1 is a front elevation in full section of a typical embodiment of the invention taken along the line 1-1 of FIG. 2 which Figure shows only a portion of the embodiment in FIG. 1 and viewed in the direction of the arrows in FIG. 2.

A typical embodiment of the invention is shown in FIG. 1. A generally rectangular flat plate 10 with a thickness of ⅜ inch to ½ inch has on one side of the plate 10 a support surface 11 and a drain surface 12 on the other side of the plate 10. The plate 10 preferably is formed from High Density Polyethylene (HDPE) or Acrylonitrile Butadiene Styrene (ABS), although any other suitable material will be acceptable.

Figure 2:
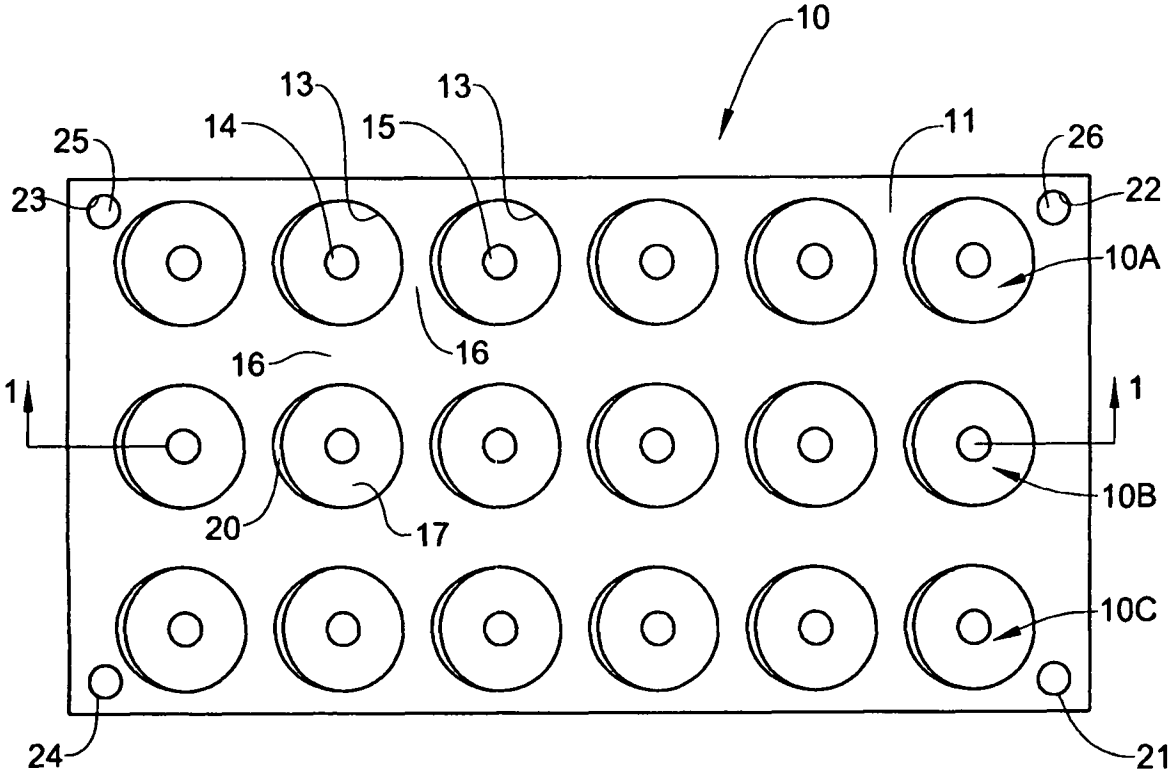
FIG. 2 is a plan view of a plate for use in connection with the embodiment of the invention shown in FIG. 1.

The plate 10 has, as best shown in FIG. 2, three rows 10A, 10B, 10C of six holes 13 in each of these rows. Each of the holes 13 for the purpose of the embodiment of the invention shown in FIG. 2 has a radius of 1⅝ inches. Note that the invention is not limited in its scope to specific dimensions and an array of eighteen holes, but can accommodate more (or less) of the holes 13 in accordance with storage and cooling needs.

Each of the holes 13 that are formed in the plate 10 are separated from the adjacent holes, center 14 to center 15, through a web 16 with a minimum width of one quarter of an inch. These dimensions, it has been found will accommodate the circumferences of about 90% of beverage bottles 17 (FIG. 1) offered for retail sale while preventing each of the bottles 17 from coming into physical contact with the adjacent bottles. In this way breakage of the bottles 17 caused by handling during ordinary use of thermally insulated or cooler chest 32 is essentially eliminated. This accommodation for the bottles 17 also includes a small gap 20 between the individual bottles 17 and the respective surrounding portions of the associated holes 13 in plate 10.

A further set of four plate support holes 21, 22, 23 and 24 (FIG. 2) are formed each in a respective one of the four corners of the plate 10. Legs, of which only the legs 25, 26 are shown in FIG. 1, are mounted, respectively, in plate support holes 23, 22 in order to stabilize the plate 10 and the bottles 17 in the chest 32. Best shown in FIG. 3, the leg 25 is a hollow tube, having a wall thickness of 0.08 inches to 0.2 inches and a length of abut 2¾ inches, with a maximum outside diameter of approximately 1.6 inches. A terminal, tapered portion 27 of the leg 25 has a length from leg end 30 to the body of the leg 25 of essentially 1.9 inches, tapering from a minimum diameter of about 1.3 inches toward the body of the leg 25 to a maximum tapered diameter of approximately 1.4 inches. Preferably, each of the four legs are of HDPE or other suitable material.

Figure 3:
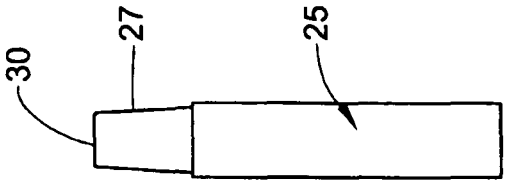
FIG. 3 is a front elevation of a leg for supporting the plate shown in FIG. 1.

In operation, each of the tapered ends of the legs (of which only the tapered terminal portion 27 is shown in FIG. 3) is inserted into one of the respective mating plate support holes 21 through 24 and retained in that support hole through a force fit, as shown in connection with the legs 25, 26 in FIG. 1. The fully assembled plate and leg structure is then placed with the legs resting on bottom 31 of the chest 32. The bottles 17 each are seated in the respective support holes 13 and are held in an upright position, with a lower portion 33 of each of the bottles 17 resting on the bottom 31 of the chest 32.

Upper portions 34 of the bottles 17 protrude above the support surface 11 of the plate 10 and, in this way, the small gaps 20 are established between the outer surfaces of the bottles 17 mounted in the associated holes 13 and the opposing surfaces of the holes 13. A cooling medium, such as crushed ice 35, or ice cubes and other suitable cooling materials is packed in the volume within the cooler chest 32 that is established by the support surface 11, the outer surfaces of the upper portions 34 of the bottles 17, walls of the chest 32 (of which only walls 36, 37 are shown in FIG. 1) and top cover 40 for the chest 32. The ice 35, as best shown in FIG. 1 is uniformly distributed among the protruding upper portions 34 of the bottles 17, thereby providing an improved distribution of the cooling ice 35 for conductively cooling the contents of the bottles 17.

Gradually, while cooling the contents of the bottles 17, not only through conduction between the ice 35 and the upper portions 34 of the bottles 17, but also through convection by means of which cooled, more dense liquid 50 within the upper portions 34 of the bottles 17 displace warmer, less dense liquid 51 within the lower portions 33 of the bottles 17. As a consequence, the efficiency of the entire cooling process is significantly improved through applications both of thermal conductivity directly between the ice 35 and the upper portions 34 of the bottles 17, and through thermal convection 50, 51 within the contents of the individual bottles 17. The melted ice water also flows through the gaps 20 between the bottles 17 and the surfaces of their respective holes 13 to the bottom 31 of the chest 32.

The melted ice water provides further cooling as it flows along the sides of the bottles 17 and pours through the gaps 20. The cold water also forms with the bottom 31 of the chest 32, a reservoir of cooling water for the bottles 17 in cold water pool 41.

When finished with the need for the cooling chest 32, the remaining bottles 17 are removed for storage and later use. Any remaining ice is scooped out of the upper portion of the chest 32 and the plate 10 and the associated legs 25, 26 are removed from the chest 32 for cleaning, drying and storage.

The now empty chest 32 is tilted to pour out the melted ice water in the pool 41. The chest 32 is then cleaned and dried for use again.

Figure 4:
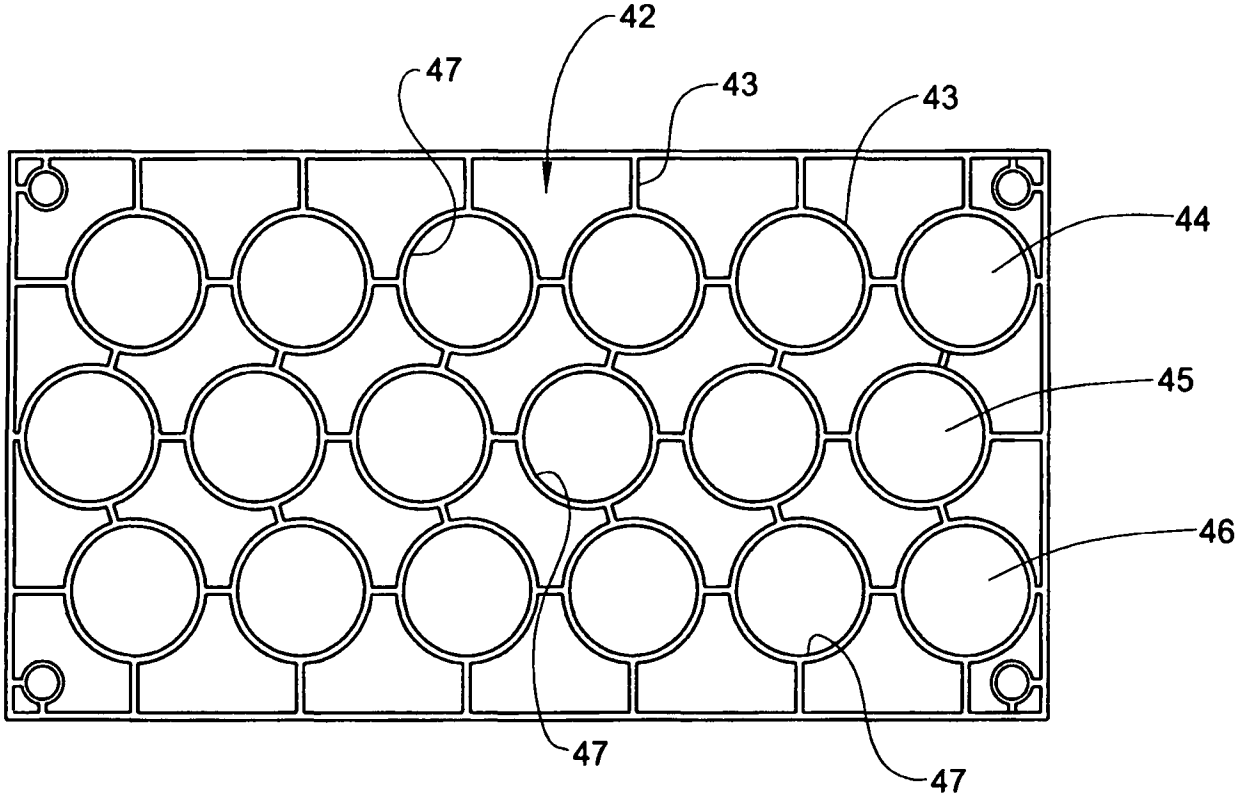
FIG. 4 is a plan view of the drain surface for an alternative plate for use in connection with the embodiment of the invention shown in FIG. 1.

FIG. 4 shows an alternative plate 42 from the underside of the plate 42.

The plate 42 is an injection molded part formed from HDPE (or other suitable material) and consists of a top (not shown) and bottom that are one piece molded together during an injection molding process that utilizes two pieces of tooling (also not shown). This tooling comes together in a controlled heated process and plastic resin is injected between the two tools. Then these tools are cooled rapidly and separated, creating the one piece plate 42. The plate 42 has a noticeable marriage line (not shown in the drawing) where the two tools meet during the injection molding process. The view from the underside of the plate 42 shows ribs 43 generally perpendicular to the plane of the underside of the plate 42 and molded into the plate 42 to add to the strength and rigidity of the plate 42. The ribs 43 also allow the plate 42 to be of a lighter weight relative to the plate 10 (FIG. 2).

Attention is particularly invited to rows 44, 45, 46 of holes 47 in FIG. 4 which show a staggered relation between the row 45 and the adjacent rows 44 and 46. Thus, in accordance with a feature of the invention the individual rows 10A, 10B, 10C (FIG. 2) and 44, 45, 46 (FIG. 4) can be increased or decreased in number, aligned, staggered or otherwise distributed as cooling and bottle storage needs require. Similarly, more, or less than the eighteen holes 17 (FIG. 2) and 47 (FIG. 4) can be provided in the plate 42, also as needs suggest.

There are other embodiments of the invention in which, for example, shelves can be formed on the inner surface of the cooling chest 32 on which the plate 10 can rest, thereby avoiding a need to supply legs to support and stabilize the plate 10.

What is claimed is:

1. An apparatus for cooling liquid stored in bottles for use with a cooling medium in a thermally insulated chest, the apparatus comprising a plate having a first plurality of spaced holes each for receiving a respective one of the bottles therein and a second plurality of holes, wherein said first holes each have a radius of about 1¾ inches, said first holes being spaced to prevent bottles positionable in said first holes from physical contact with one another, said first holes establishing gaps to enable flow of the cooling medium through said gaps, a support surface on one side of said plate for supporting the cooling medium thereon, the support surface defining a convective cooling area via the cooling medium, and a plurality of legs for supporting said plate within the thermally insulating chest, the legs being secured in the second plurality of holes in the plate, wherein each of said legs further comprises a hollow tube having a length of about 2¾ inches and a maximum diameter of about 1.6 inches, an end of said leg tapering from a maximum diameter of about 1.4 inches to a minimum approximate diameter of 1.3 inches at the end of said leg.

2. An apparatus according to claim 1 further comprising a plurality of webs formed in said plate, each of said webs individually spacing pairs of said first holes from each other.

3. An apparatus for conductive and convective cooling of liquid in bottles stored in ice, the apparatus comprising a cooling chest, a plate having a thickness of about ½ inch and disposed in the cooling chest, a plurality webs having a minimum width of about one quarter of an inch and holes formed in said plate separated by a distance that prevents bottles positionable in said holes from contacting one another, each of said holes having a radius to form a gap between the bottles and said respective webs formed in said plate, the webs defining a support surface for the ice, the apparatus further including four legs for supporting said plate within the cooling chest above a bottom surface of the cooling chest, said plate having corners, each leg being mounted on said plate and generally perpendicular thereto at a separate one of said corners thereof, said legs each having a hollow tube, tapered at one end thereof in order to establish a force-fit with said plate and to support and stabilize said plate, wherein the plate is positioned in the cooling chest such that the ice supported on the plate is positioned to make contact with upper halves of the bottles to create a convective cooling circulation in response to variations in a density of the liquid in the bottles, and wherein the holes are sized such that melted ice flows in said gaps.

4. An apparatus according to claim 1, wherein said plurality of legs are press-fit into said second plurality of holes, respectively.

* * * * *